US006726976B2

(12) United States Patent
Dimitri

(10) Patent No.: US 6,726,976 B2
(45) Date of Patent: Apr. 27, 2004

(54) TUFTED PILE STRUCTURE HAVING BINDER CONCENTRATED BENEATH THE BACKSTITCHES

(75) Inventor: Zafiroglu P. Dimitri, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/148,720

(22) PCT Filed: Nov. 30, 2000

(86) PCT No.: PCT/US00/32546

§ 371 (c)(1),
(2), (4) Date: May 29, 2002

(87) PCT Pub. No.: WO01/40563

PCT Pub. Date: Jun. 7, 2001

(65) Prior Publication Data

US 2002/0182368 A1 Dec. 5, 2002

Related U.S. Application Data

(60) Provisional application No. 60/168,557, filed on Dec. 2, 1999.

(51) Int. Cl.[7] ..... D05C 17/00

(52) U.S. Cl. ..... 428/95; 428/156; 428/167; 28/107; 28/111; 28/112; 28/159; 427/208.2; 427/286; 427/288; 427/372.2

(58) Field of Search ..... 428/17, 85, 95, 428/156, 167; 28/107, 111, 112, 159; 427/208.2, 256, 282, 286, 288, 372.2; 66/194

(56) References Cited

U.S. PATENT DOCUMENTS 1,827,614 A 10/1931 Riviere
2,261,096 A 10/1941 Reinhardt (List continued on next page.)

FOREIGN PATENT DOCUMENTS

DE 2935387 3/1981
DE 3119636 6/1982

(List continued on next page.)

OTHER PUBLICATIONS

Malimo®, *Sewing–Knitting Machines, Six Parts, discussing Technical Possibilities and Technology*., no date.
Mayer, Karl. Tricot Machine pamphlet. Jan. 15, 1997.
Mohawk Commercial Carpet Pamphlet, dated Nov. 1994.
Malimo®, *Sewing–Knitting Machines, Six machine types for the manufacture of the most various textile fabric constructions made of fibres and threads*. 1974.
Teppich–Wirkmaschine Carpet Knitting Machine, Model 14 125, pamphlet, no date.

*Primary Examiner*—Deborah Jones
*Assistant Examiner*—Wendy Boss
(74) *Attorney, Agent, or Firm*—George M. Medwick

(57) ABSTRACT

A concentrate of binder at the tufts produces a lighter and more flexible carpet, which allows for direct attachment of hook-and-loop means on the carpet backing. Thermoplastic binder yarns are pinned by the pile yarns against the primary backing. Subsequent application of heat melts the binder yarns and fuses the tufts and primary backing together. An alternate embodiment uses highly shrinkable binder sheet placed over the backing before tufting, instead of the binder yarns.

6 Claims, 5 Drawing Sheets

U.S. PATENT DOCUMENTS

| | | | |
|---|---|---|---|
| 2,429,281 | A | 10/1947 | Solins |
| 2,448,928 | A | 9/1948 | Stahl |
| 2,892,331 | A | 6/1959 | Kelly |
| 3,009,235 | A | 11/1961 | De Mestral |
| 3,070,983 | A | 1/1963 | Hubbard et al. |
| 3,109,302 | A | 11/1963 | Vitek |
| 3,168,883 | A | 2/1965 | Ploch et al. |
| 3,230,917 | A | 1/1966 | Wignall et al. |
| 3,253,426 | A | 5/1966 | Mauersberger |
| 3,401,657 | A | 9/1968 | Watkins |
| 3,602,011 | A | 8/1971 | Barton et al. |
| 3,677,206 | A | 7/1972 | Maclsaac, Jr. et al. |
| 3,722,442 | A | 3/1973 | Maclsaac, Jr. et al. |
| 3,727,433 | A | 4/1973 | Hamano |
| 3,837,943 | A | 9/1974 | Ploch et al. |
| 4,026,129 | A | 5/1977 | Sternlieb |
| 4,103,630 | A | 8/1978 | Wignall |
| 4,159,360 | A | 6/1979 | Kim |
| 4,192,159 | A | 3/1980 | Kohl |
| 4,244,312 | A | 1/1981 | Bialy |
| 4,347,718 | A | 9/1982 | Haverland et al. |
| 4,406,309 | A | 9/1983 | Czelusniak, Jr. |
| 4,502,902 | A | 3/1985 | Zurcher et al. |
| 4,619,853 | A | 10/1986 | Blyth et al. |
| 4,624,878 | A | 11/1986 | Evans et al. |
| 4,818,316 | A | 4/1989 | Weinle et al. |
| 4,863,777 | A | 9/1989 | Callaway et al. |
| 4,871,604 | A | 10/1989 | Hackler |
| 4,998,421 | A | 3/1991 | Zafiroglu |
| 5,038,584 | A | 8/1991 | Wildeman |
| 5,102,482 | A | 4/1992 | Rogers, Jr. |
| 5,445,860 | A | 8/1995 | Bova |
| 5,447,590 | A | 9/1995 | Gilpatrick |
| 5,470,629 | A | 11/1995 | Mokhtar et al. |
| 5,472,762 | A | 12/1995 | Edwards et al. |
| 5,498,459 | A | 3/1996 | Mokhtar et al. |
| 5,510,142 | A | 4/1996 | Groshens |
| 5,532,035 | A | 7/1996 | Corbin et al. |
| 5,575,228 | A | 11/1996 | Padgett, III et al. |
| 5,605,107 | A | 2/1997 | Padgett, III et al. |
| 5,626,912 | A | 5/1997 | Hendrix et al. |
| 5,699,593 | A | 12/1997 | Jackson |
| 5,866,229 | A | 2/1999 | Gartner et al. |
| 5,902,757 | A | 5/1999 | Stern et al. |
| 6,338,885 | B1 * | 1/2002 | Prevost |
| 6,521,554 | B1 | 2/2003 | Wildeman |

FOREIGN PATENT DOCUMENTS

| | | |
|---|---|---|
| DE | 244582 | 4/1987 |
| DE | 4228563 | 3/1994 |
| DE | 94 11 993.7 | 11/1994 |
| DE | 4335109 | 4/1995 |
| DE | 19506845 | 8/1996 |
| DE | 4417692 | 4/1997 |
| EP | 0347206 | 6/1988 |
| EP | 0529575 | 3/1993 |
| EP | 0568916 | 11/1993 |
| GB | 1074741 | 7/1967 |
| GB | 1 427 191 | 3/1976 |
| GB | 2140047 | * 11/1984 |
| JP | 37-12031 | 8/1962 |
| JP | 43-20277 | 8/1968 |
| JP | 63-203854 | 8/1988 |
| JP | 247352 | 2/1990 |
| JP | 6128862 | 5/1994 |
| JP | 291447 | 11/1996 |
| WO | WO 9803711 | 1/1998 |
| WO | WO 00/52246 | * 9/2000 |

* cited by examiner

TUFTED PILE STRUCTURE HAVING BINDER CONCENTRATED BENEATH THE BACKSTITCHES

This application claims the benefit of provisional application No. 60/168,557, filed Dec. 2, 1999.

BACKGROUND OF THE INVENTION

1. Field of the Invention

The present invention relates to a tufted pile surface structure and to a method for producing the same in which binder material is concentrated beneath the backstitch portions of the pile yarns.

2. Description of the Prior Art

In the manufacture of a tufted pile surface structure each of a plurality of pile yarns is drawn by a tufting needle through a backing to form face fiber elements and backstitch elements. The face fiber elements lie adjacent to the upper face of the backing while the backstitch elements are disposed along the lower face of the backing. Presently, the backstitch elements are secured by a thermoset or thermoplastic binder placed on the lower face of the backing. In actuality, only a small portion of the binder material serves to hold the backstitch elements in place, while a large portion of the binder material is wasted. Using very large quantities of binder to achieve deeper penetration of the binder through the backing to improve pull-out or unraveling resistance increases binder wastage, stiffens the carpet, and increases carpet weight.

Accordingly, it is believed advantageous to provide a method of manufacture of a tufted pile surface structure that concentrates binder material beneath the backstitch elements to produce a lighter and more flexible carpet structure. Such a structure will also allow the direct deployment "hook-loop" attachment members on the back of the carpet.

SUMMARY OF THE INVENTION

The present invention is directed to a pile surface structure and a process for manufacturing the same Each of a plurality of pile yarns is tufted by a separate tufting needle through a plurality of needle insertion points in the backing to form face fiber elements that lie adjacent to the upper face of the backing and backstitch elements that overlay the lower face of the backing. The insertion points produced by the tufting needles form a pattern of parallel lines that extend longitudinally and transversely along the back face of the backing.

An activated binder material is disposed beneath the backstitch elements to hold the backstitch elements to the backing. The activated binder material is concentrated along the longitudinal and/or the transverse lines of insertion points, with the lower face of the backing member between the adjacent lines of insertion points being left substantially free of binder.

In accordance with this invention the binder material is applied before tufting. The binder material may take the form of either a sheet or a plurality of longitudinally laid strands of binder material that when activated, form stripes of binder extending along the lower face of the backing member. During tufting each needle passes through the binder material so that binder is disposed between the backstitch elements and the lower face of the backing.

BRIEF DESCRIPTION OF THE DRAWINGS

The invention will be more fully understood from the following detailed description, taken in connection with the accompanying drawings, which form a part of this application and in which:

FIG. 2A is a stylized perspective view taken along view lines A—A of FIG. 1 showing a pile surface structure in accordance with a first embodiment of the present invention as produced within the tufting apparatus and prior to heat treatment wherein the binder takes the form of a sheet of binder material, while FIG. 3A is a stylized perspective view taken along view lines A—A of FIG. 1 in accordance with an alternate embodiment of the present invention as produced within the tufting apparatus and prior to heat treatment wherein the binder takes the form of a plurality of strands of binder material, while

DESCRIPTION OF PREFERRED EMBODIMENT

Figure 1:
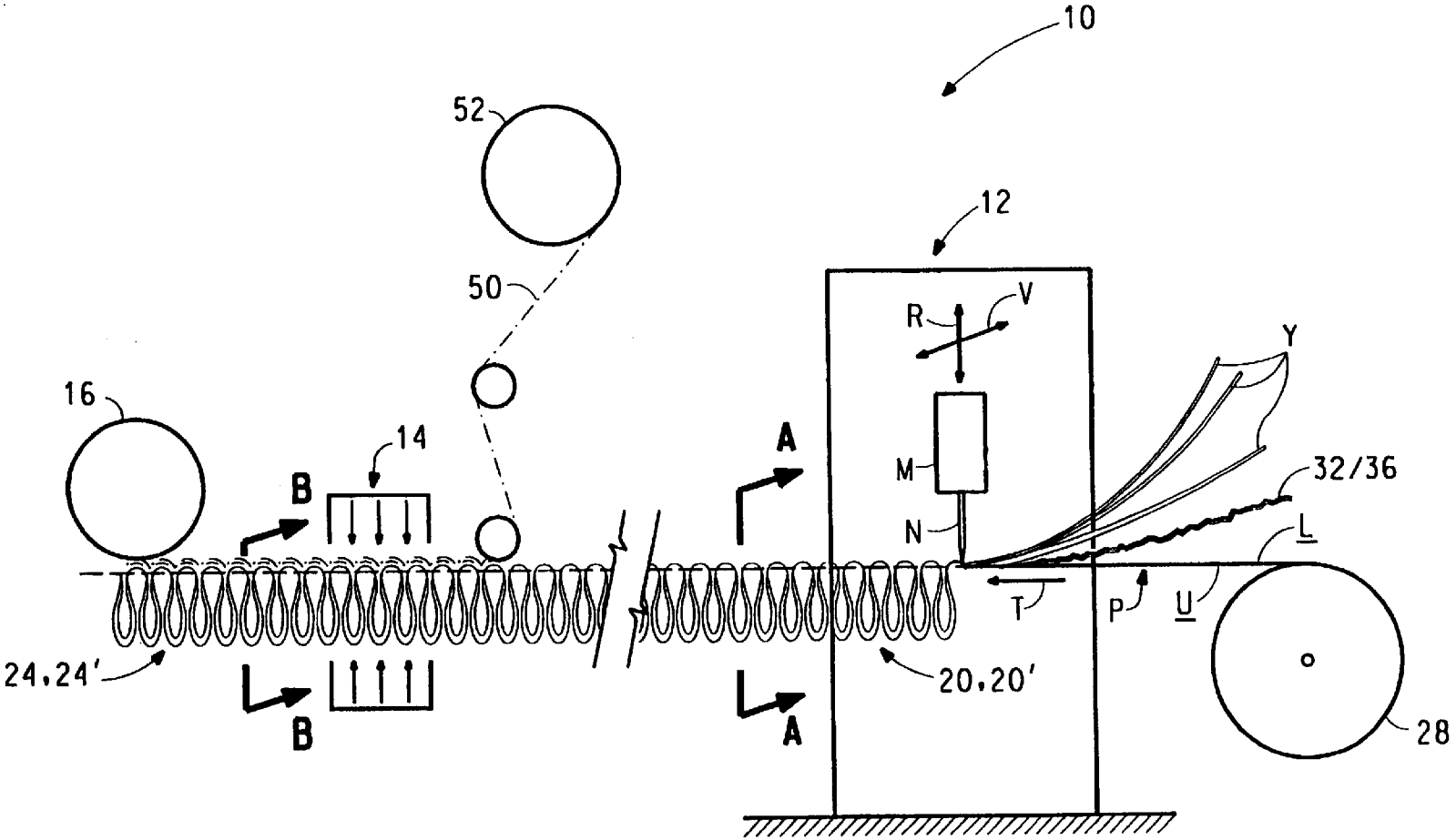
FIG. 1 is a diagrammatic illustration of a tufting system for practicing the method in accordance with the present invention to produce a tufted pile surface structure also in accordance with the present invention.

Throughout the following detailed description similar reference numerals refer to similar elements in all figures of the drawings.

FIG. 1 is a diagrammatic illustration of an overall system 10 for producing and finishing a tufted pile surface structure in accordance with the present invention. The system 10 includes a tufting apparatus generally indicated by the reference character 12 followed by a heat finishing apparatus generally indicated by the reference character 14. The tufting apparatus 12 and the heat finishing apparatus 14 may be physically disposed in the same housing, if desired. Downstream of the heat finishing apparatus 14 is a compression roller 16. The temperature of the roller 16 is typically kept at room temperature.

The tufting apparatus 12 produces a tufted pile surface structure generally indicated by the reference character 20, 20' in accordance with the alternate embodiments of the present invention. The pile surface structure 20 is illustrated herein in FIG. 2A (taken at vantage points A—A), while the pile surface structure 20' is illustrated in FIG. 3A (taken at the same vantage points A—A). The tufted pile surface structure 20, 20' produced by the tufting apparatus 12 is heat treated in the finishing apparatus 14. The finished tufted pile surface structure in accordance with the alternate embodiments of the present invention is generally indicated herein by the reference character 24, 24', respectively illustrated in FIGS. 2B and 3B. Both FIGS. 2B and 3B are viewed from vantage points B—B.

The basic operation of the tufting apparatus 12 to produce a pile surface structure in accordance with the alternate embodiments of the present invention may now be discussed in connection with FIGS. 1, 2A and 3A. A primary backing P, having an upper face U and a lower face L, is dispensed from a roll 28 and is conveyed along a generally planar path of travel T through the tufting apparatus 12. The direction of travel of the primary backing P through the apparatus 12 is termed the "longitudinal" or the "machine" direction. The direction perpendicular to the longitudinal direction is termed the "transverse" direction. The primary backing P is conveyed in the longitudinal direction through the tufting apparatus 12 with its lower face L presented upwardly.

Within the tufting apparatus 12 a plurality of tufting needles N is carried by a movable needle bar M. Each tufting needle N is supplied with a pile yarn Y dispensed from a creel (not shown). Each needle N is reciprocally movable in the directions R to tuft each of the pile yarns Y into the backing P at a plurality of spaced needle insertion points I (FIGS. 2A, 3A). The insertion points I produced by the reciprocating tufting needles N form a pattern of parallel lines $L_L$, $L_T$, that respectively extend in the longitudinal and in the transverse directions along the backing P.

As is well understood by those skilled in the art, during the basic operation of the tufting apparatus 12 the reciprocating insertion and retraction of the needles N form looped face fiber elements F that lie adjacent to the upper face U of the primary backing P. The face fiber F elements may be later cut, if desired. As the primary backing P is linearly advanced along the path of travel T lengths of yarn overlay the lower face L of the backing P between longitudinally adjacent needle insertion points I to define linear backstitch elements B shown in the foreground portion of FIGS. 2A, 3A.

Alternatively, as appreciated by those skilled in the art, in addition to being vertically reciprocable, the needle bar M may also be transversely movable with respect to the backing P in the directions V. In this event, as the primary backing P is linearly advanced along the path of travel T, backstitch elements B' are formed that diagonally overlay the lower face L of the backing P across one or more longitudinal lines $L_L$ of adjacent needle insertion points I. The backstitch elements B' are shown in the background portion of FIGS. 2A, 3A.

The tufted pile surface structure in accordance with this invention includes a binder material therein. In accordance with the present invention the binder material is applied before the tufting operation. The binder material is introduced in either solid sheet form or solid strand form dispensed from a suitable supply roll(s) or packages (not shown), as the case may be.

Figure 2A:
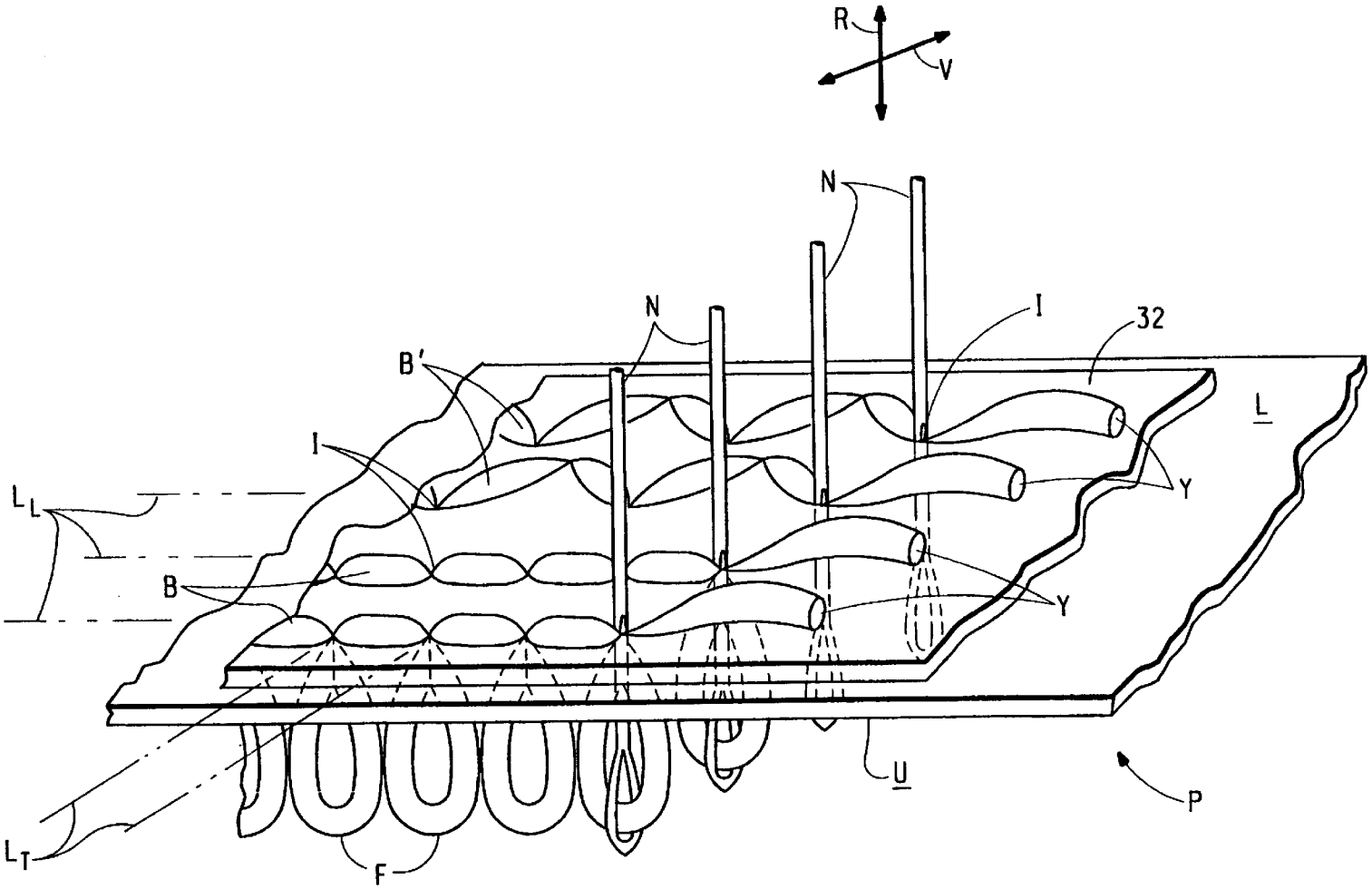
Figure 2B:
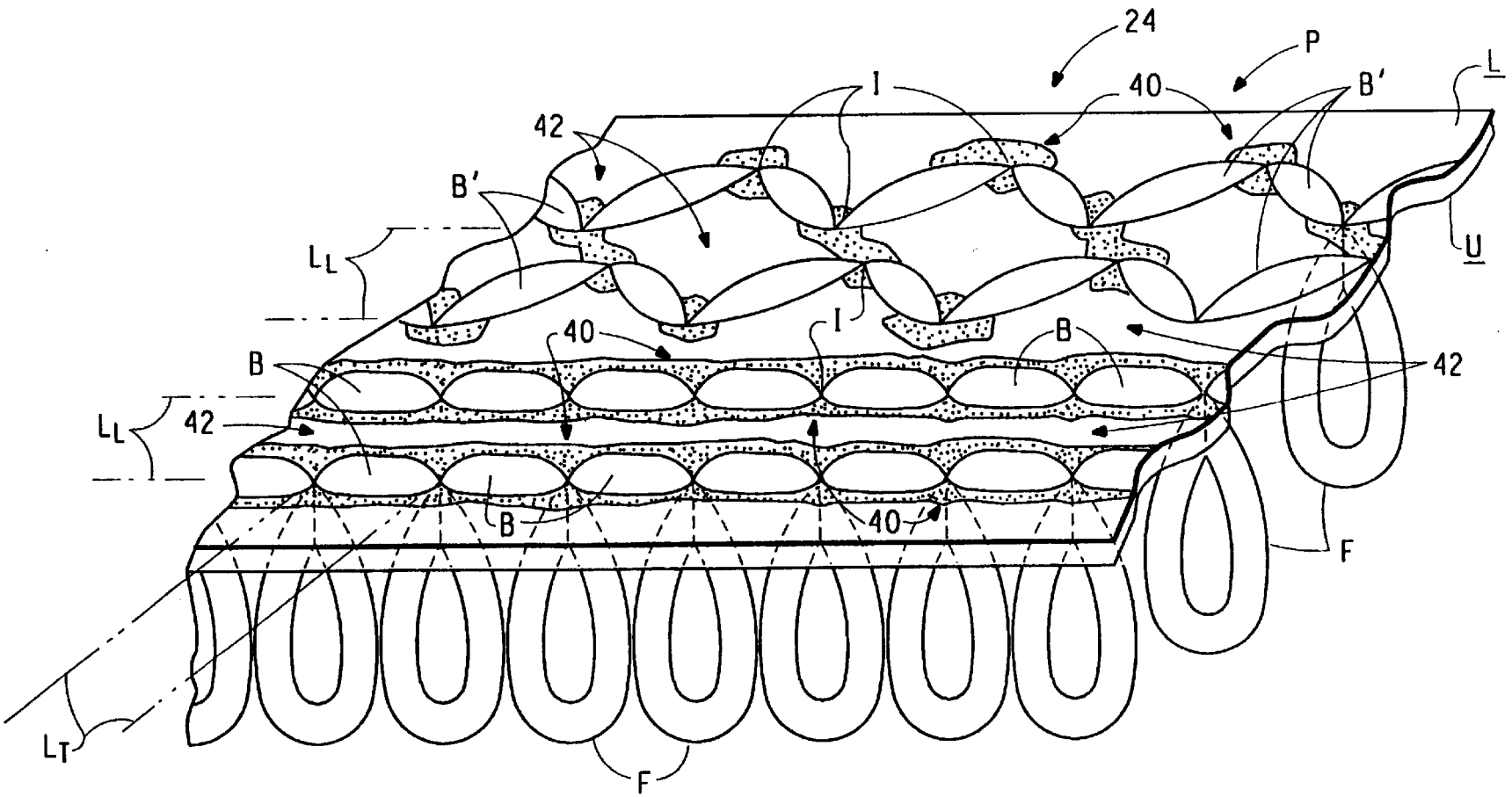
FIG. 2B is a stylized perspective view taken along view lines B—B of FIG. 1 showing the same embodiment of the pile surface structure as produced at the output of the heat treating apparatus.
Figure 3A:
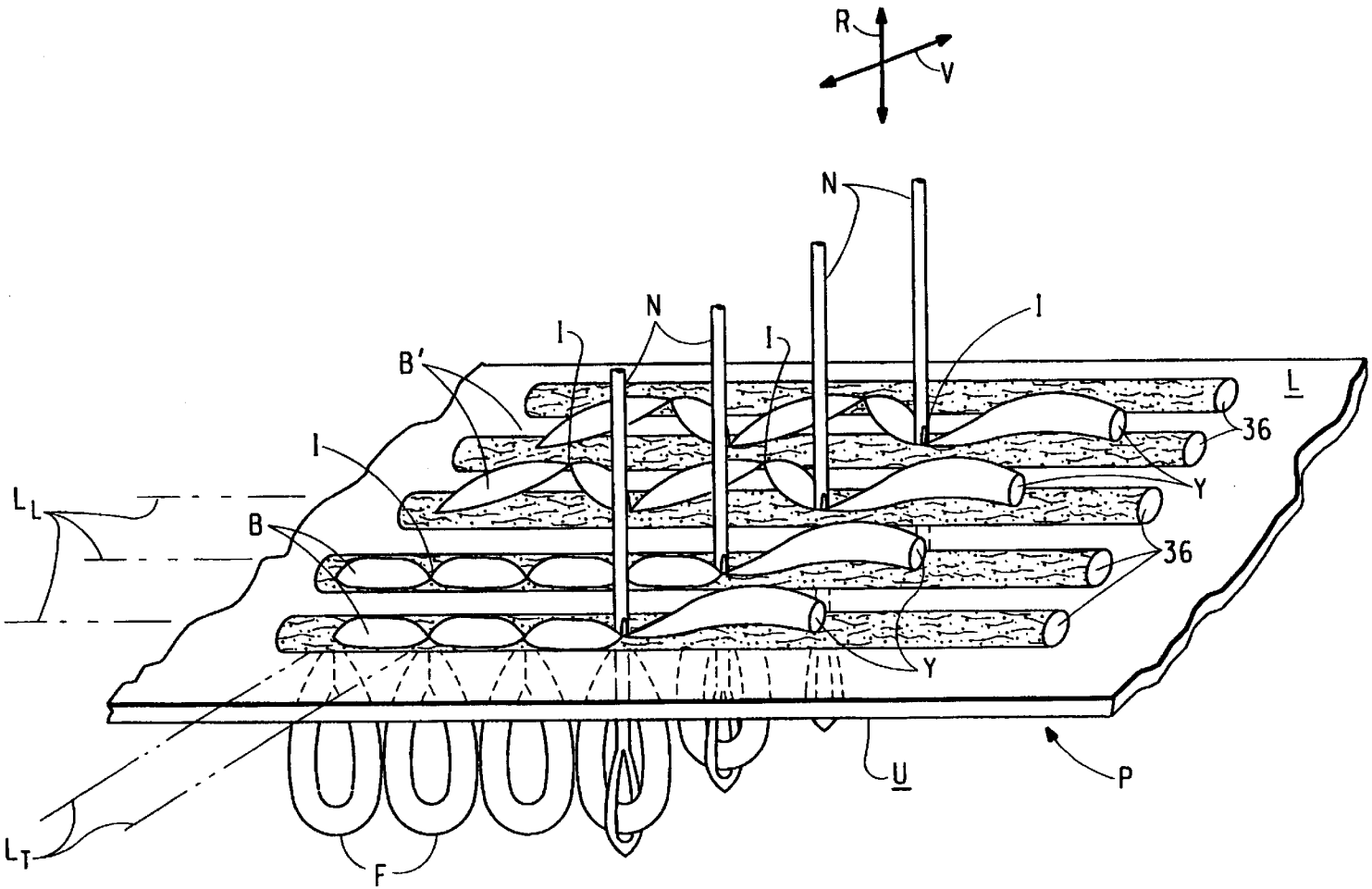
Figure 3B:
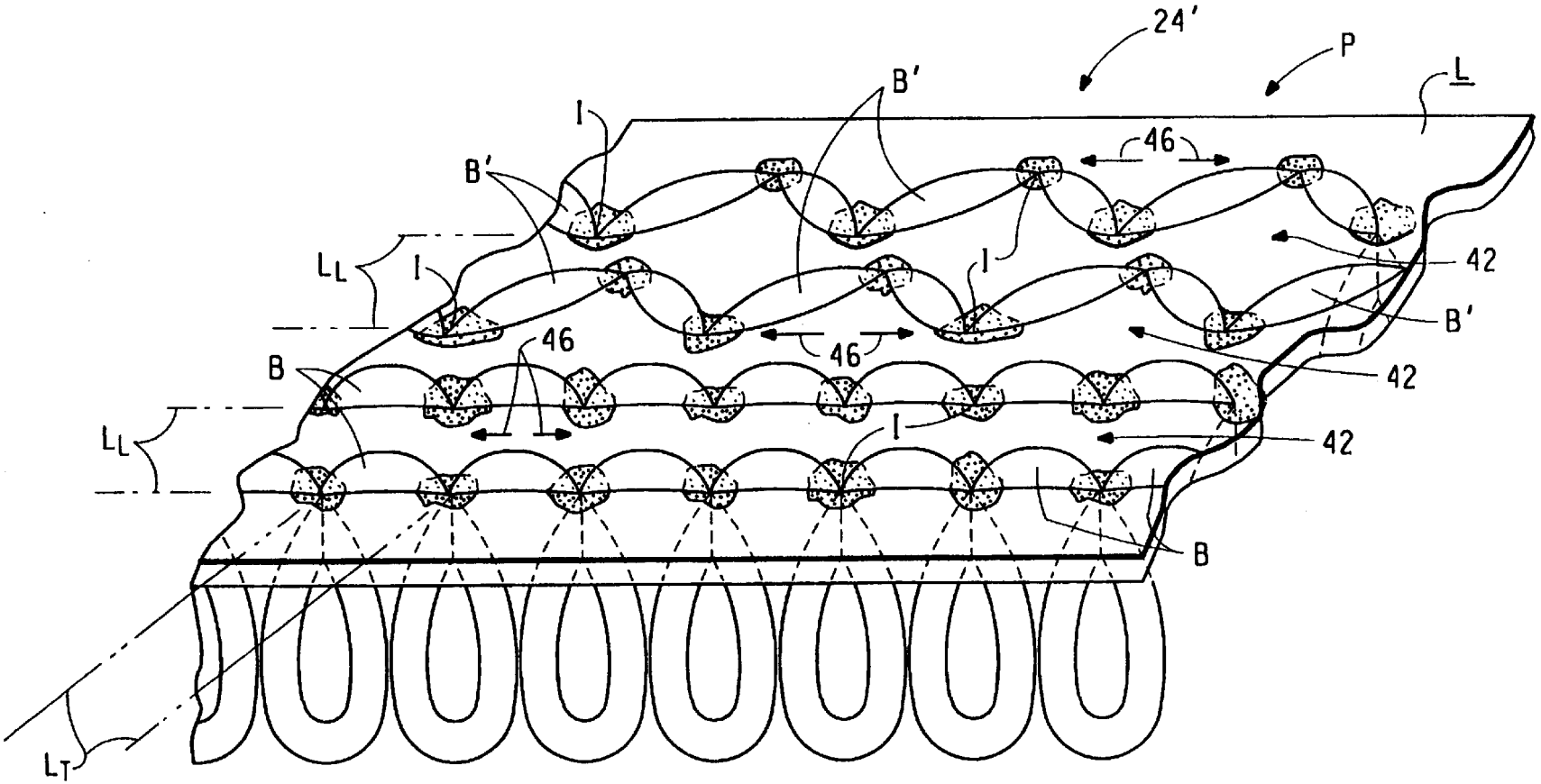
FIG. 3B is a stylized perspective view taken along view lines B—B of FIG. 1 showing the same embodiment of the pile surface structure as produced at the output of the heat treating apparatus.

FIG. 2A illustrates the tufted pile surface structure 20 when the binder material is introduced in the form of a sheet 32. The sheet 32 is dispensed from a supply roll and is drawn into the apparatus 12. The sheet 32 is laid onto the lower face L of the backing P at a point upstream of the needles N.

FIG. 3A illustrates the tufted pile surface structure 20' when the binder material is introduced in the form of strands 36. Each strand 36 is dispensed from a suitable package (not shown) and is conveyed by a suitable guide apparatus, such as guide tubes, toward the needles N. The end of the guide apparatus terminates at a point just upstream of the nip of the needle N.

Whether the binder is introduced as a sheet 32 or as individual binder strands 36, during tufting the needles N pass through the binder material so that the pile yarns Y extend through the binder material and so that binder material is disposed beneath the backstitch elements B, B'. That is, the binder material 32, 36 is disposed between the backstitch elements B, B' and the lower face L of the backing P. The backstitch elements B, B' serve to "pin" the binder against the primary backing P.

As noted earlier, located downstream of the tufting apparatus 24 is a finishing apparatus 14 that heat-treats the tufted pile surface structure 20, 20' produced by the apparatus 12 to activate the binder material therein. Subsequent application of heat from the lower face L melts the binder and causes the backstitch elements and the primary backing to fuse together. The preferred method of heating in this case is to apply heat without compressing the product to allow free movement of the binder before appearing cold pressure to set the binder.

FIG. 2B illustrates the finished pile surface structure 24 in the instance wherein the binder material is applied in the form of sheets 32. In this case the application of heat causes the sheet 32 of binder material to shrink, soften and break into binder segments that coalesce toward the needle insertion points I, as is selectively illustrated at various points in FIG. 2B by the arrows 40. Binder material becomes concentrated at the needle insertion points I where it is most effectively utilized to attach the backstitch elements B, B' to the backing P. In accordance with the present invention the activated binder material is present only in the vicinity of the needle insertion points I. Those portions of the lower face L of the backing P between adjacent parallel longitudinal and transverse lines of needle insertion points $L_L$, $L_T$, respectively, remain substantially free of binder. These binder-areas are selectively illustrated in FIG. 2B by the reference characters 42.

FIG. 3B illustrates the finished pile surface structure 24' when the binder is applied in the form of strands. Upon the application of heat the strands of binder material shrink, soften and break into binder segments before the segments melt and flow longitudinally toward the needle insertion points I as is selectively illustrated at various points in FIG. 3B by the arrows 46. The activated binder material is concentrated along the longitudinally extending lines $L_L$ of needle insertion points. The lower face of the backing member between adjacent longitudinal lines $L_L$ of insertion points is left substantially free of binder. These binder-areas are again selectively illustrated in FIG. 3B by the reference characters 42.

When the binder is introduced in strand form maximum contact between the binder strands and the backstitch elements B is achieved when the tufting needle propagation path is linear, as illustrated in the foreground portion of FIG. 3A. When the needle propagation path moves transversely across rows to produce diagonally extending backstitch elements B' illustrated in the background portion of FIG. 3A, contact between the binder strands and the backstitch elements B occurs only in the vicinity of the needle insertion points I.

As seen from FIG. 1 a secondary backing 50 may be optionally applied to the pile surface structure 20, 20'. The secondary backing 50 is drawn from a roll 52 as the pile surface structure 20, 20' enters the finishing apparatus 14. Depending upon the relative denier of pile yarn, the viscosity of the melted binder and the pressure applied during binder activation, binder material can also flow through or around the backstitch elements B, B', allowing the application of a secondary backing 50 to the pile surface 20, 20' without the need of any additional binder. The roller 16 (FIG. 1) can be useful to press together the binder material, the backstitch elements B, B', and the secondary backing 50.

Binder: The preferred binder sheet is formed of a highly shrinkable thermoplastic sheet in which the direction and degree of shrinkage can be controlled by controlling the heat-treatment process of the sheet. Such sheets that can be pre-combined with the primary backings in advance by light tacking. Such sheets include wovens, knits or nonwovens made with partially oriented low-melting yarns, low-melting nonwovens containing drawn non-relaxed yarns such as a spunbounded nonwoven material sold by E. I du Pont de Nemours and Company under the trademark Typar®, and low-melting blown or extruded films that are multiaxially or uniaxially oriented but not fully relaxed. It has been observed that such sheets shrink, break and melt, concentrating the binder towards the backstitch elements in the vicinity of the needle insertion points, resulting in the presence of binder on a very small fraction of the total surface area of the lower surface of the backing P.

The binder strands are preferably formed from a low-melting thermoplastic polymer with a heat-finishing process that causes them to shrink substantially in the longitudinal direction before melting.

The finished pile surface structure 24, 24' in accordance with the present invention is believed to provide significant advantages over conventional tufted pile surface structures. Since the latex binder is omitted, the finished pile surface structure 24, 24' is lighter in weight than a conventional tufted pile surface structure. Because of the discrete bonding pattern that leaves binder-free areas 42 on the lower surface of the backing P the finished pile surface structure 24, 24' is also softer than conventional tufted pile surface structures.

If, as is preferred, the finished pile surface structure 24, 24' is fabricated of all thermoplastic materials, it is both free of solvent and other chemical emissions and is fully recyclable. Assuming appropriate choices of materials for the binder, the primary and the secondary backing (if any), (as for example, polyester), it is dimensionally stable against temperature and moisture variations. Since the lower face of the backing between adjacent lines of insertion points is left substantially free of binder, pins or hooks can easily penetrate through the binder-free areas of the primary and/or secondary backings to aid installation. Also, since a secondary backing is be bonded to the primary with a pattern of discrete points or stripes the secondary backing may itself have a "loop" surface, suitable for hook-loop applications.

Since the heat required to set the binder material is less than that required to cure conventional latex, the finishing/bonding operation in the heat-treatment apparatus 14 may be performed in-line with the tufting operation.

What is claimed is:

1. A tufted pile structure comprising:

a backing having an upper and a lower face thereon;

a plurality of yarns tufted into the backing, each yarn being tufted by a separate tufting needle through a plurality of needle insertion points in the backing to form face fiber elements that lie adjacent to the upper face of the backing and backstitch elements that overlay the lower face of the backing, the insertion points produced by the tufting needles forming a pattern of parallel lines that extend along the backing; and an activated binder material disposed beneath the backstitch to hold the backstitch elements to the backing, the activated binder material being concentrated along the lines of insertion points with the lower face of the backing between adjacent lines of insertion points being left substantially free of binder.

2. The tufted pile structure of claim 1 wherein the pattern of parallel lines extends longitudinally along the backing.

3. A method for producing a pile surface structure comprising the steps of:

(a) conveying a backing along a path of travel, the backing having an upper face and a lower face;

(b) applying a binder material to the backing;

(c) after applying the binder material, using a separate tufting needle for each of a plurality of yarns, tufting each yarn through the binder material and into the backing at a plurality of longitudinally spaced insertion points to form face fiber elements that lie adjacent to the upper face of the backing and backstitch elements that overlay the lower face of the backing, the binder material being disposed between the backstitch elements and the backing, the insertion points produced by the tufting needles forming a pattern of parallel lines that extend along the backing; and (d) heating the structure to activate the binder material to hold the backstitch elements to the backing with the lower face of the backing member between adjacent lines of insertion points being left substantially free of binder.

4. The method of claim 3 wherein the pattern of parallel lines extends longitudinally along the backing.

5. The method of claim 3 wherein the step of applying a binder material comprises the step of laying a plurality of stripes of binder material longitudinally along the lower face of the backing member.

6. The method of claim 3 wherein the step of applying a binder material comprises the step of laying a sheet of binder material on the lower face of the backing member.

* * * * *